US007522031B2

(12) United States Patent
Lim

(10) Patent No.: US 7,522,031 B2
(45) Date of Patent: Apr. 21, 2009

(54) APPARATUS AND METHOD FOR CONTROLLING ALARM BY MOTION RECOGNITION IN A PORTABLE TERMINAL

(75) Inventor: Seok-Hun Lim, Suwon-si (KR)

(73) Assignee: Samsung Electronics Co., Ltd (KR)

( * ) Notice: Subject to any disclaimer, the term of this patent is extended or adjusted under 35 U.S.C. 154(b) by 326 days.

(21) Appl. No.: 11/542,406

(22) Filed: Oct. 3, 2006

(65) Prior Publication Data

US 2007/0075858 A1 Apr. 5, 2007

(30) Foreign Application Priority Data

Oct. 4, 2005 (KR) ..... 10-2005-0092948

(51) Int. Cl.
*G08B 1/00* (2006.01)

(52) U.S. Cl. ..... 340/309.16; 340/309.7; 340/384.1; 340/384.7; 340/384.71; 368/69; 368/72; 368/74

(58) Field of Classification Search ..... 340/309.16, 340/309.2, 309.7, 384.1, 384.7, 384.71, 388.1; 368/10, 12, 67, 72, 73, 227, 230, 69, 74, 368/250, 251, 263

See application file for complete search history.

(56) References Cited

U.S. PATENT DOCUMENTS

| | | | | |
|---|---|---|---|---|
| 5,524,101 | A * | 6/1996 | Thorgersen et al. | 368/10 |
| 6,036,358 | A * | 3/2000 | Montrose | 368/134 |
| 6,163,507 | A * | 12/2000 | Gholson | 368/12 |
| 6,359,840 | B1 * | 3/2002 | Evans | 368/80 |
| 6,940,395 | B2 * | 9/2005 | Steinmark | 340/309.16 |
| 7,266,047 | B2 * | 9/2007 | Chan | 368/10 |
| 2003/0142591 | A1 * | 7/2003 | Baweja et al. | 368/263 |

* cited by examiner

*Primary Examiner*—Hung T. Nguyen
(74) *Attorney, Agent, or Firm*—The Farrell Law Firm, PC

(57) ABSTRACT

The present invention relates to an apparatus and a method for controlling an alarm using motion recognition in a portable terminal. In the method, motion input of the portable terminal is sensed in an alarm mode. It is checked whether the motion is a predetermined motion in a motion database. If the motion is the predetermined motion, a re-alarm time corresponding to the motion is set.

20 Claims, 2 Drawing Sheets

APPARATUS AND METHOD FOR CONTROLLING ALARM BY MOTION RECOGNITION IN A PORTABLE TERMINAL

PRIORITY

This application claims priority under 35 U.S.C. § 119 to an application entitled "Apparatus And Method for Controlling Alarm By Motion Recognition In A Portable Terminal" filed in the Korean Intellectual Property Office on Oct. 4, 2005 and assigned Serial No. 2005-92948, the contents of which are incorporated herein by reference.

BACKGROUND OF THE INVENTION

1. Field of the Invention

The present invention relates to a method for setting a re-alarm function which is delayed from the first alarm using motion recognition in an alarm mode.

2. Description of the Related Art

Along with the rapid development of wireless telecommunication technology, portable terminals with functions of wireless voice communication and information exchange have become necessities.

Due to their convenient portability and developed technologies, portable terminals have, besides portable a wireless calling function, various functions such as a phone book function, a game function, a short message function, an Internet function, an e-mail function, a morning call or wake-up function, a MPEG Layer3 function, a digital camera function, personal information storing function, scheduler function and an alarm function.

In particular, an alarm function of the portable terminal of a user who is traveling, on a business trip or even at home, is frequently used instead of an alarm clock.

Conventionally, the alarm function of portable terminal outputs a preset melody or alarm at a preset time. If a user stops the alarm and keeps sleeping when the alarm function is operated, the original purpose of alarm function is not achieved.

A method of a snooze alarm function has been proposed to solve the above problem. The snooze alarm is an alarm which keeps -ringing at predetermined time intervals until the alarm function is cancelled. However, because the snooze alarm rings only at the predetermined time intervals, it cannot actively respond to the user's condition or schedule.

Accordingly, it is necessary to provide an apparatus and method for easily setting a re-alarm time by a user in a portable terminal.

SUMMARY OF THE INVENTION

Accordingly, an object of the present invention is to provide an apparatus and method for easily setting a re-alarm time which is delayed from the first alarm using motion recognition of the portable terminal.

Another object of the present invention is to provide an apparatus and a method for setting a delay time for a re-alarm by sensing the number of times in which a user handles the portable terminal in an up/down or left/right motion.

Another object of the present invention is to provide an apparatus and a method for setting a re-alarm delay time corresponding to motion by sensing motion of a portable terminal.

According to an apparatus of the present invention for achieving the above objects, in a portable terminal for setting a re-alarm time with motion recognition, a motion sensor for sensing a motion of the portion terminal, a memory for storing a motion database having at least one re-alarm time corresponding to the motion sensed by the motion sensor and a controller for searching the re-alarm time corresponding to the sensed motion by the motion sensor from the motion database of the memory when the motion of the portable terminal is inputted in an alarm mode, and for setting the searched re-alarm time are provided.

According to a method of the present invention for achieving the above objects, in a method of setting a re-alarm time with motion recognition in a portable terminal, sensing a motion input of the portable terminal in an alarm mode, checking whether the sensed motion is among predetermined motions in a motion database and setting a re-alarm time corresponding to the predetermined motion is performed.

BRIEF DESCRIPTION OF THE DRAWINGS

The above and other objects, features, and advantages of the present invention will become more apparent from the following detailed description when taken in conjunction with the accompanying drawings in which.

DETAILED DESCRIPTION OF THE PREFERRED EMBODIMENTS

Preferred embodiments of the present invention will be described herein below with reference to the accompanying drawings. In the following description, well-known functions or constructions are not described in detail in order to avoid obscuring the present invention in unnecessary detail.

The present invention relates to a method for providing a re-alarm function which is delayed from the first alarm time using motion recognition in a portable terminal in an alarm mode, and will be described with reference to FIGS. 1 and 2 below.

Figure 1:
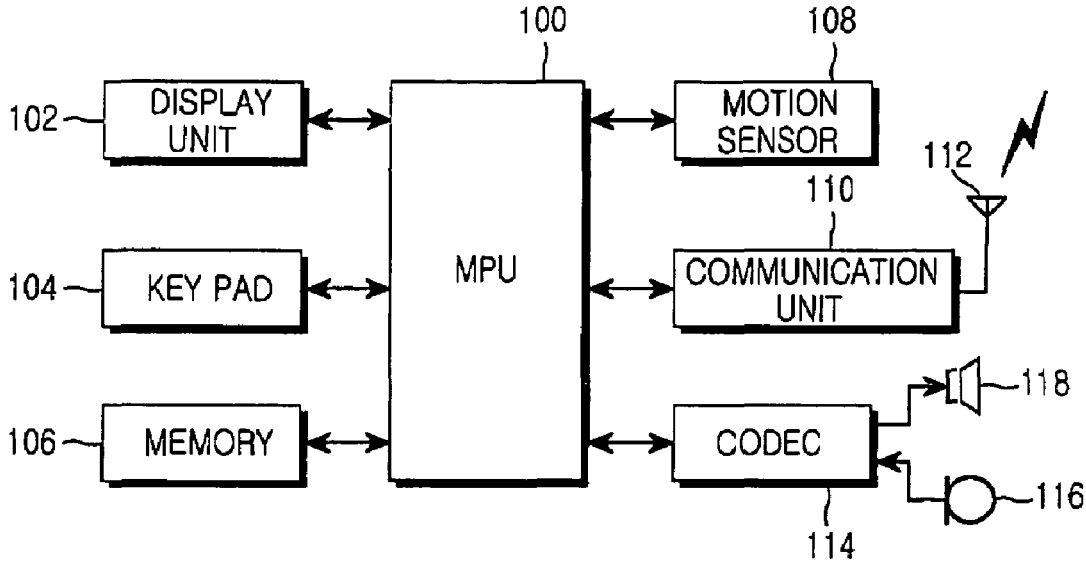
FIG. 1 is a block diagram of a portable terminal controlling an alarm using motion recognition according to the present invention.

FIG. 1 is a block diagram of a portable terminal controlling an alarm using motion recognition according to the present invention.

Referring to FIG. 1, the portable terminal controlling an alarm using a motion recognition function includes a Micro-Processor Unit (MPU), i.e. a controller, 100, a display unit 102, a key pad 104, a memory 106, a motion sensor 108, a communication unit 110, an antenna 112, a Coder-Decoder (CODEC) 114, a microphone 116 and a speaker 118.

A MPU 100 controls an overall operation of the portable terminal with a function of controlling an alarm by using motion recognition. For example, the MPU 100 is responsible for processing and controlling voice communication and data communication. In addition, the MPU 100 processes a function for searching motion information corresponding to an input motion in a motion database if a motion sensor senses the input motion when using an alarm in an alarm mode. The MPU 100 provides a motion delay time corresponding to the searched motion information and outputs the motion delay time to a display unit 102 or through a speaker 118, and provides control to re-output a re-alarm signal which is delayed for the motion delay time. A detailed description of the typical processing and controlling operation of the MPU 100 will not be described.

A display unit 102 displays status information (or indicator), limited numbers and characters, moving pictures and still pictures and the like. The display unit 102 may be a Liquid Crystal Display (LCD).

A key pad 104 includes numeric keys of digits 0-9 and a plurality of function keys, such as a MENU key, a CANCEL (REMOVE) key, an ENTER key, a TALK key, an END key, an Internet connection key, and navigation keys (▲/▼/◄/►). The key input data corresponding to a key pressed by the user is transmitted to the MPU 100.

A memory 106 stores software for controlling the overall operation of the portable terminal and temporarily stores data created during the operation of the terminal. Also, the memory 106 stores data (phone numbers, short message service messages, image data etc.). In addition to typical functions, the memory 106 stores a motion database having motion information corresponding to a portable terminal input motion.

A motion sensor 108 measures the motion status of the portable terminal. The motion sensor 108, which is an acceleration measuring device, measures acceleration of X, Y and Z axes, and then measures a slope of the portable terminal. The motion sensor 108 identifies a motion of the portable terminal based on the measured values.

A communication unit 110, in case of the data reception, drops a frequency of an RF signal received through the antenna 112 and converts to a baseband signal, and performs de-spreading and channel decoding for receiving data. Also, the communication unit 110 receives a base station identification number through a pilot channel. For the data transmission, the communication unit 110 performs channel coding and spreading transmitting data.

A Coder-Decoder (CODEC) 114 connected to the MPU 100, a microphone 116, and a speaker 118 connected to the CODEC are audio input/output blocks for use in voice communication. The MPU 100 produces Pulse Code Modulation (PCM) data and the CODEC 114 converts the PCM data into analog audio signals. The analog audio signals are output through the speaker 118. Also, the CODEC 114 converts analog audio signals received through the microphone 116 into PCM data and provides the PCM data to tempo 100.

Figure 2:
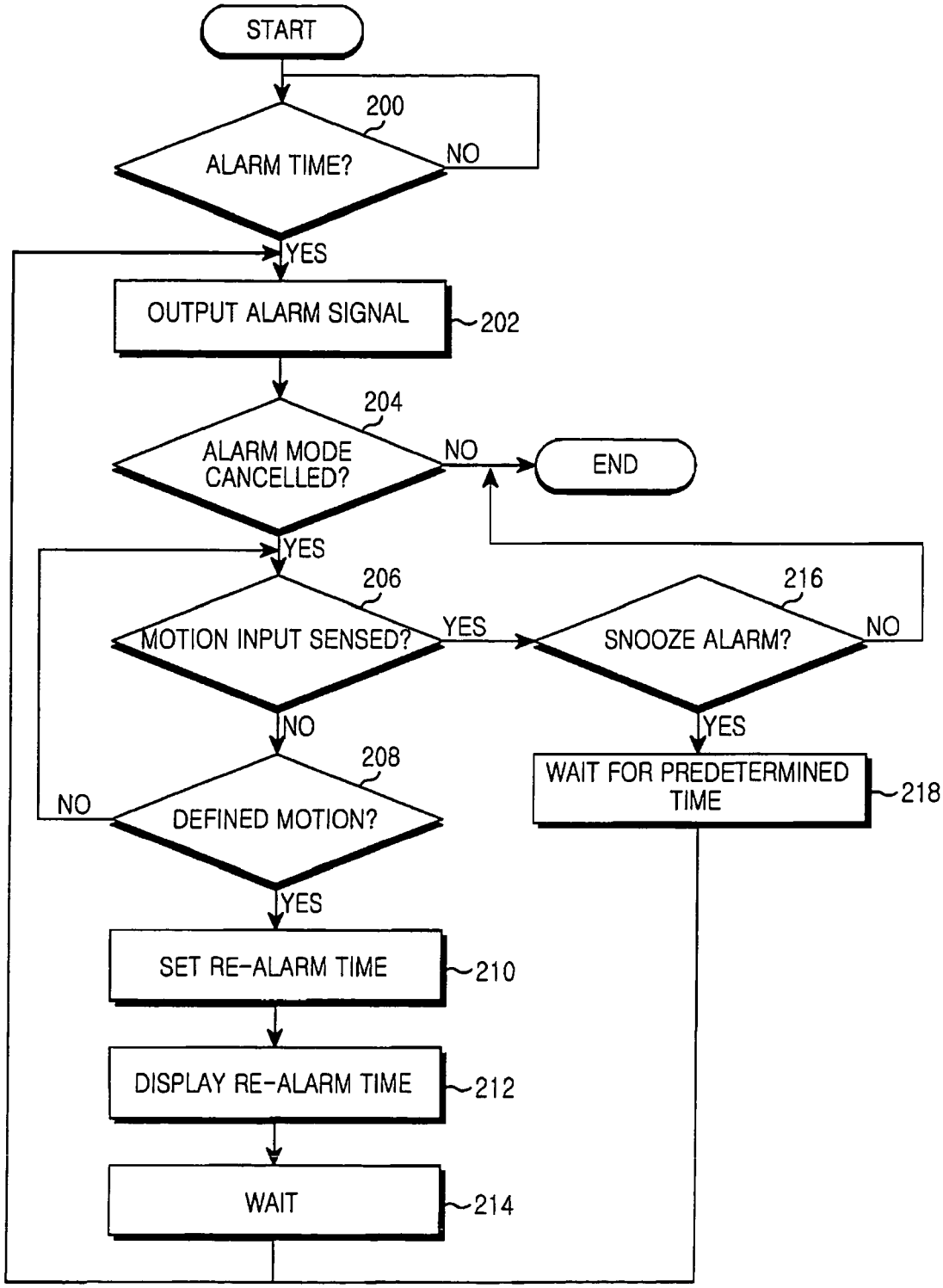
FIG. 2 is a flowchart illustrating a flow of controlling an alarm using the motion recognition according to the present invention.

FIG. 2 is a flowchart illustrating a flow of controlling an alarm using the motion recognition according to the present invention.

In step 200, it is checked whether the present time is the alarm time. If the present time is the alarm time, an alarm signal is output in step 202. After this, it is checked whether the alarm is cancelled in step 204. If the alarm is cancelled, an alarm mode ends.

If the alarm is not cancelled, it is checked whether the portable terminal motion input is sensed in step 206. If the motion input is sensed, it is checked whether motion information corresponding to the sensed motion exists in a motion database in step 208. That is, it is determined whether the sensed motion is a predefined motion stored in a motion database. The motion database comprises a plurality of re-alarm times corresponding to the plurality of predefined motions.

If the sensed motion is not a predefined motion, the process returns to step 206. If the sensed motion is a predefined motion, a re-alarm time corresponding to the sensed motion is set in step 210. The re-alarm time is a time delayed from the first alarm. After this, in step 212, the re-alarm time is displayed on a display unit 102. The re-alarm time may be output as voice through a speaker. In step 214, waiting for a re-alarm time is performed and the process returns to step 202.

The re-alarm time in step 206 is a delay time for re-alarm setting from the first alarm according to a motion of portable terminal sensed by the motion sensor 108.

The re-alarm time may be extended by the number of times that a user tips the portable terminal in an up/down or left/right direction or motion. The number of times a motion is made extends the re-alarm time. Also, the re-alarm time may be extended by a numeric number that the user inputs to the portable terminal by a key manipulation or a screen touching.

If the motion input is not sensed, it is checked whether the alarm mode is a snooze alarm mode in step 216. If the alarm mode is not the snooze alarm mode, the alarm mode ends. If the alarm mode is the snooze alarm mode in step 218, waiting for the predetermined time is performed and the process returns to step 202.

As described above, the present invention relates to control a re-alarm setting time by sensing a motion of the portable terminal. The present invention provides an apparatus and a method by which the user can easily set a re-alarm time.

While the present invention has been shown and described with reference to certain preferred embodiments thereof, it will be understood by those skilled in the art that various changes in form and details may be made therein without departing from the spirit and scope of the present invention as defined by the appended claims.

What is claimed is:

1. A portable terminal for setting a re-alarm time with motion recognition, comprising:

a motion sensor for sensing a motion of the portable terminal;

a memory for storing a motion database having at least one re-alarm time corresponding to the motion sensed by the motion sensor; and a controller for searching the re-alarm time corresponding to the sensed motion by the motion sensor from the motion database of the memory when the motion of the portable terminal is input in an alarm mode, and for setting the searched re-alarm time.

2. The portable terminal of claim 1, further comprising a display unit for displaying the re-alarm time set by the controller.

3. The portable terminal of claim 1, further comprising a speaker for outputting the re-alarm time set by the controller.

4. The portable terminal of claim 1, wherein the re-alarm time is extended by sensing a number of times of left/right or up/down movement of the portable terminal.

5. The portable terminal of claim 1, wherein the re-alarm time is extended by sensing a numerical number of a motion made by of the portable terminal.

6. A method of setting a re-alarm with motion recognition in a portable terminal, comprising the steps of:

sensing a motion input of the portable terminal in an alarm mode;

checking whether the sensed motion is among predetermined motions in a motion database; and setting a re-alarm time corresponding to the predetermined motion.

7. The method of claim 6, further comprising outputting the re-alarm time as a voice.

8. The method of claim 6, further comprising displaying the re-alarm time on a display unit.

9. The method of claim 6, further comprising extending the set re-alarm time by sensing a number of left/right or up/down movements of the portable terminal.

10. The method of claim 6, further comprising extending the set re-alarm time by sensing a numerical number of a motion made by the portable terminal.

11. A portable terminal for setting an alarm time with motion recognition, comprising:

a motion sensor for sensing a motion of the portable terminal;

a memory for storing motion information; and a controller for setting an alarm time according to the motion information corresponding to the sensed motion of the portable terminal.

12. The portable terminal of claim 11, further comprising a speaker for outputting the set alarm time as voice.

13. The portable terminal of claim 11, further comprising a display unit for displaying the set alarm time.

14. The portable terminal of claim 11, wherein the alarm time is extended by sensing a number of times of left/right or up/down movement of the portable terminal.

15. The portable terminal of claim 11, wherein the alarm time is extended by sensing a numerical number of a motion made by the portable terminal.

16. A method of setting an alarm time with motion recognition in a portable terminal, comprising the steps of:

sensing a motion input of the portable terminal in an alarm mode; and setting an alarm time according to motion information corresponding to the sensed motion of the portable terminal if the sensed motion is among motion information.

17. The method of claim 16, further comprising outputting the alarm time as a voice.

18. The method of claim 16, further comprising displaying the alarm time on a display unit.

19. The method of claim 16, further comprising extending the set alarm time by sensing a number of left/right or up/down movements of the portable terminal.

20. The method of claim 16, further comprising extending the set alarm time by sensing a numerical number of a motion made by the portable terminal.

* * * * *